US008297309B2

(12) United States Patent
Wang

(10) Patent No.: US 8,297,309 B2
(45) Date of Patent: Oct. 30, 2012

(54) AIR PUMP DEVICE AND ITS INFLATABLE PRODUCT

(76) Inventor: Cheng-Chung Wang, Taipei (TW)

( * ) Notice: Subject to any disclaimer, the term of this patent is extended or adjusted under 35 U.S.C. 154(b) by 1083 days.

(21) Appl. No.: 11/871,937

(22) Filed: Oct. 12, 2007

(65) Prior Publication Data

US 2008/0087342 A1 Apr. 17, 2008

(30) Foreign Application Priority Data

Oct. 13, 2006 (CN) ..... 2006 2 0065513 U

(51) Int. Cl.
*F04B 37/00* (2006.01)
*A47C 27/08* (2006.01)

(52) U.S. Cl. ..... 137/565.15; 5/655.03; 417/423.14; 137/224

(58) Field of Classification Search ..... 137/223, 137/224, 565.15, 234.5, 516.15, 516.17, 137/524, 542; 5/706, 710, 713, 715, 655.3; 417/315, 307, 371, 423.14
See application file for complete search history.

(56) References Cited

U.S. PATENT DOCUMENTS 121,659 A * 12/1871 Prescott ..... 137/542
1,247,623 A * 11/1917 Black et al. ..... 417/63
2,051,100 A * 8/1936 Nelson ..... 137/542
2,719,986 A * 10/1955 Rand ..... 5/713
3,027,915 A * 4/1962 Huffman et al. ..... 137/516.15
3,147,763 A * 9/1964 Morton ..... 137/234.5
3,260,276 A * 7/1966 Stasiunas ..... 137/234.5
3,392,412 A * 7/1968 Aymar ..... 5/713
3,780,768 A * 12/1973 Soderstrom ..... 137/625.48
4,394,784 A * 7/1983 Swenson et al. ..... 5/706
4,478,587 A * 10/1984 Mackal ..... 137/224
4,644,597 A * 2/1987 Walker ..... 5/706
4,766,628 A * 8/1988 Walker ..... 5/706
4,829,616 A * 5/1989 Walker ..... 5/713
4,890,344 A * 1/1990 Walker ..... 5/713
4,908,895 A * 3/1990 Walker ..... 5/706
5,141,024 A * 8/1992 Hicks ..... 137/542
5,249,319 A * 10/1993 Higgs ..... 5/713
5,267,363 A * 12/1993 Chaffee ..... 5/713
5,367,726 A * 11/1994 Chaffee ..... 5/706
5,890,882 A * 4/1999 Feldman ..... 5/713
5,903,941 A * 5/1999 Shafer et al. ..... 5/713
6,089,251 A * 7/2000 Pestel ..... 137/234.5
6,202,239 B1 * 3/2001 Ward et al. ..... 5/713
6,257,269 B1 * 7/2001 Wu ..... 137/224
6,483,264 B1 * 11/2002 Shafer et al. ..... 5/713
6,530,751 B1 * 3/2003 Song et al. ..... 5/713
6,709,246 B2 * 3/2004 Boyd ..... 5/713
7,020,921 B2 * 4/2006 Wang ..... 5/713
7,039,972 B2 * 5/2006 Chaffee ..... 5/706

(Continued)

*Primary Examiner* — Craig Schneider
*Assistant Examiner* — Craig J Price
(74) *Attorney, Agent, or Firm* — Hershkovitz & Associates, LLC; Abraham Hershkovitz

(57) ABSTRACT

An inflatable product has an air pump device and a pressure releasing valve. The air pump device has a housing and a pumping assembly. The housing has two openings as an inlet opening and an outlet opening. The pumping assembly is mounted in the housing and has a motor and a fan. The motor is mounted between the inlet and outlet openings and drives the fan. Consequently, mounting the motor between the first opening and the second opening dissipates the heat of the motor because the air passing by the motor cools the motor. The pressure releasing valve is adjusted by users and releases air while pressure of air in the inflatable body reaches a predetermined pressure level.

17 Claims, 5 Drawing Sheets

U.S. PATENT DOCUMENTS

| | | | | |
|---|---|---|---|---|
| 7,040,347 | B2 * | 5/2006 | Wang | 417/315 |
| 7,066,201 | B2 * | 6/2006 | Chen et al. | 137/541 |
| 7,096,884 | B2 * | 8/2006 | Mackal | 137/543.23 |
| 7,195,029 | B2 * | 3/2007 | Wass | 137/223 |
| 7,284,968 | B2 * | 10/2007 | Tsai | 5/655.3 |
| 7,313,837 | B2 * | 1/2008 | Wang | 5/706 |
| 7,387,290 | B2 * | 6/2008 | Wang | 251/230 |
| 7,475,443 | B2 * | 1/2009 | Wang | 5/713 |
| 7,571,500 | B2 * | 8/2009 | Wu | 5/173 |
| 7,597,123 | B2 * | 10/2009 | Wang | 5/706 |
| 7,644,724 | B2 * | 1/2010 | Chaffee | 137/223 |
| 7,726,330 | B2 * | 6/2010 | Schuster | 5/713 |
| 2003/0188387 | A1 * | 10/2003 | Leventhal et al. | 5/713 |
| 2004/0123395 | A1 * | 7/2004 | Wang | 5/713 |
| 2005/0044631 | A1 * | 3/2005 | Wang | 5/713 |
| 2005/0125904 | A1 * | 6/2005 | Tsai | 5/713 |
| 2006/0073045 | A1 * | 4/2006 | Tsai | 417/423.14 |
| 2006/0123549 | A1 * | 6/2006 | Chaffee | 5/655.3 |
| 2006/0210413 | A1 * | 9/2006 | Chung | 417/423.1 |
| 2006/0278280 | A1 * | 12/2006 | Yang | 137/542 |
| 2007/0000061 | A1 * | 1/2007 | Chung | 5/706 |
| 2007/0000569 | A1 * | 1/2007 | Wang | 141/114 |
| 2009/0089935 | A1 * | 4/2009 | Wang | 5/713 |
| 2010/0014993 | A1 * | 1/2010 | Wang et al. | 5/713 |
| 2010/0247355 | A1 * | 9/2010 | Pan | 417/423.14 |
| 2010/0278659 | A1 * | 11/2010 | Wang et al. | 417/43 |
| 2011/0011465 | A1 * | 1/2011 | Wang et al. | 137/224 |

* cited by examiner

AIR PUMP DEVICE AND ITS INFLATABLE PRODUCT

BACKGROUND OF THE INVENTION

1. Field of the Invention

The present invention relates to an air pump device, and more particularly to an air pump device that pumps air into an inflatable body and releases air automatically when the inflatable body is over-inflated.

2. Description of Related Art

Inflatable bodies are convenient to use for exhibitions, children's playgrounds, decorations, inflatable mattress, etc. and often needs a conventional air pump device to inflate the objects. The air pump device only pumps air into the inflatable body in a single mode so the inflatable body may be over-inflated if a user does not constantly monitor the inflatable body and stop the air pump device. That is not convenient.

Moreover, the conventional air pump device has an air pump and usually has a motor inside to pump air, but temperature of the motor rises very quickly because the air pump device does not have any device for dissipating heat generated by the air pump and the motor that are enclosed in the air pump device. Consequently, the air pump device cannot be used for too long and sometimes may break down because the motor easily overheats and burns out.

To overcome the shortcomings, the present invention provides an air pump device to mitigate or obviate the aforementioned problems.

SUMMARY OF THE INVENTION

The main objective of the invention is to provide an air pump device that cools the motor while pumping air into an inflatable body and releases air automatically when the inflatable body is over-inflated.

The inflatable product has the air pump device and a pressure releasing valve. The air pump device has a housing and a pumping assembly. The housing has two openings as an inlet opening and an outlet opening. The pumping assembly is mounted in the housing and has a motor and a fan. The motor is mounted between the inlet and outlet openings and drives the fan. Consequently, mounting the motor between the first opening and the second opening dissipates the heat of the motor because the air passing by the motor cools the motor. The pressure releasing valve is adjusted by users and releases air while pressure of air in the inflatable body reaches a predetermined pressure level.

Other objectives, advantages and novel features of the invention will become more apparent from the following detailed description when taken in conjunction with the accompanying drawings.

DETAILED DESCRIPTION OF PREFERRED EMBODIMENT

Figure 1:
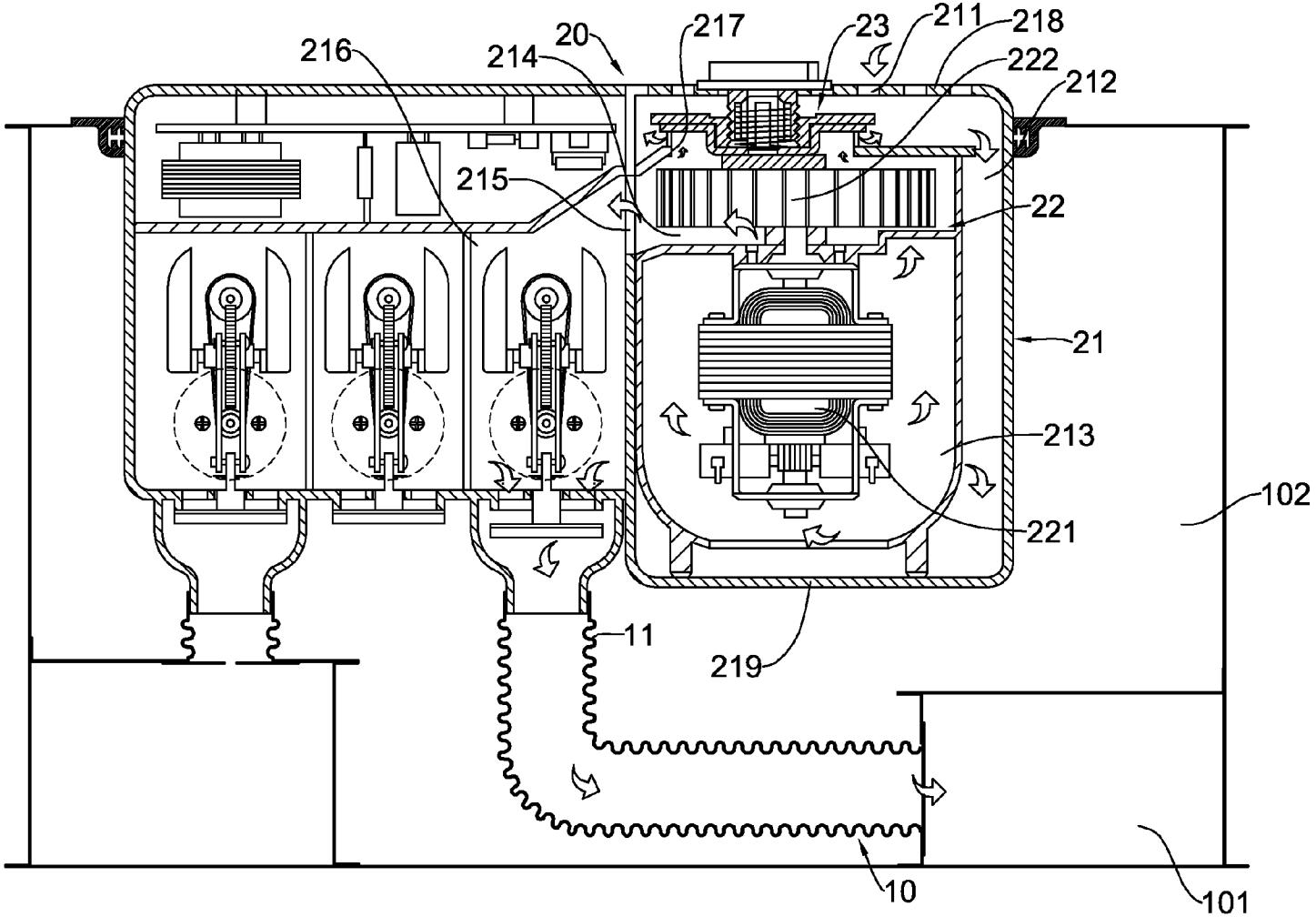
FIG. 1 is a top view in partial section of an inflatable product with an air pump device in accordance with the present invention.
Figure 2:
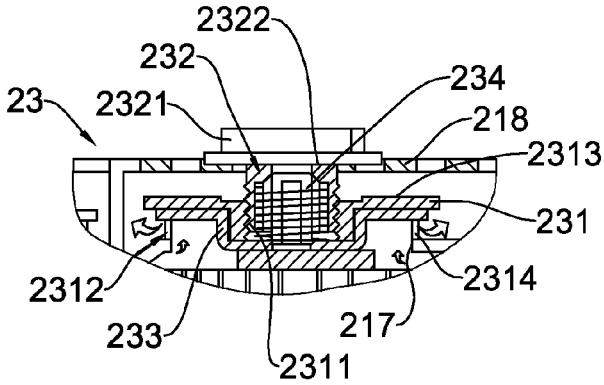
FIG. 2 is an enlarged operational top view in partial section of a pressure releasing valve in the inflatable product in FIG. 1 when the pressure releasing valve is opened.
Figure 4:
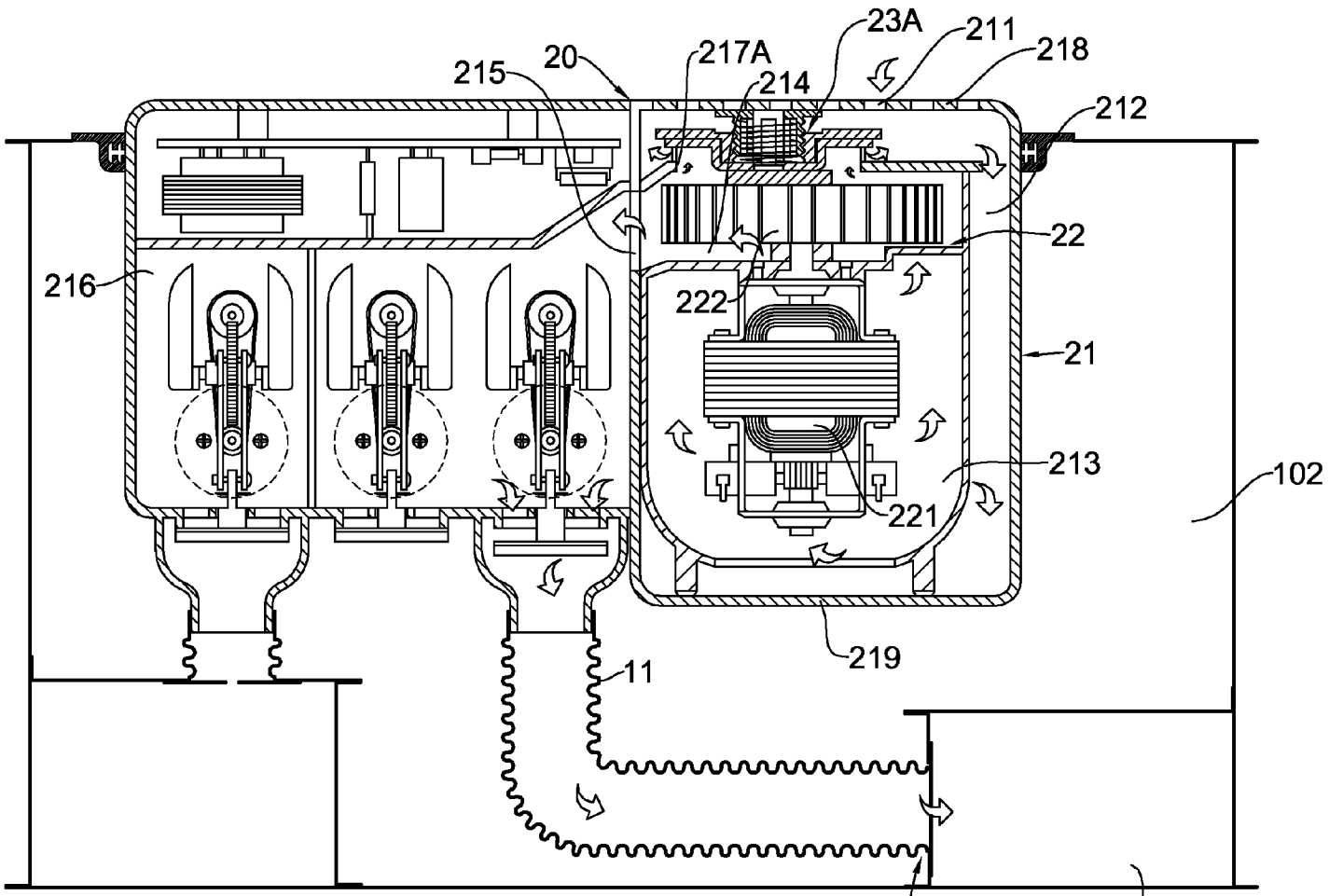
FIG. 4 is a top view in partial section of another embodiment of the inflatable product with an air pump device in accordance with the present invention.
Figure 7:
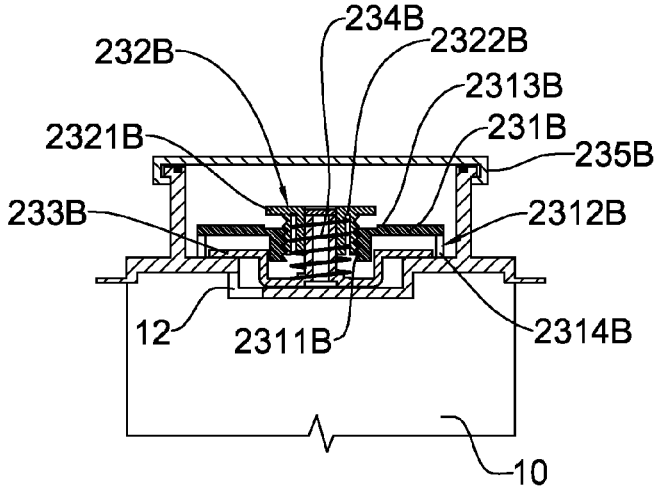
FIG. 7 is an enlarged operational top view in partial section of another embodiment of a pressure releasing valve in an inflatable product in accordance with the present invention when the pressure releasing valve is closed.

With reference to FIGS. 1, 2, 4 and 7, an inflatable product in accordance with the present invention comprises an inflatable body (10), an air pump device (20) and a pressure releasing valve (23, 23A, 23B).

The inflatable body (10) is hollow, may be a bladder or an inflatable plenum and has an inflating cavity (101), a mounting cavity (102), an inflating tube (11) and an optional opening (12). The inflating cavity (101) is formed within the inflatable body (10). The mounting cavity (102) is formed within the inflatable body (10) and is separated from the inflating cavity (10). The inflating tube (11) is mounted in the mounting cavity (102) and communicates with the inflating cavity (101). The opening (12) is formed through the inflatable body (10).

The air pump device (20) is mounted on the inflatable body (10) and in the mounting cavity (102) of the inflatable body (10), and comprises a housing (21) and a pumping assembly (22).

The housing (21) is mounted on the inflatable body (10) and in the mounting cavity (102) of the inflatable body (10), and has an outer wall (218), an inner wall (219), a first opening (211), a first air room (212), a motor room (213), a second air room (214), a second opening (215), an optional connecting room (216) and may have a third opening (217, 217A).

The outer wall (218) of the housing (21) protrudes out of the inflatable body (10). The inner wall (219) of the housing (21) is disposed in the mounting cavity (102) of the inflatable body (10) and is opposite to the outer wall (218) of the housing (21). The first opening (211) is formed through the outer wall (218) of the housing (21) and communicates with outside environment to allow air to enter into the housing (21).

The first air room (212) is formed inside the housing (21), extends from the outer wall (218) to the inner wall (219) of the housing (21) and has an outer end and an inner end. The outer end of the housing (21) corresponds to the outer wall (218) of the housing (21) and communicates with the first opening (211). The inner end of the housing (21) corresponds to the inner wall (219) of the housing (21).

The motor room (213) is formed inside the housing (21) and has an inner opening and an outer opening. The inner opening of the motor room (213) communicates with the inner end of the first air room (212). The outer opening of the motor room (213) communicates with the second air room.

The second air room (214) is formed inside the housing (21), is disposed beside the outer wall (218) of the housing (21), communicates with the inner end of the first air room (212) through the motor room (213) and has a wall.

The second opening (215) is formed through the wall of the second air room (214) and communicates with the inflating tube (11).

The connecting room (216) is formed between, connects to and communicates with the second opening (215) and the inflating tube (11).

The third opening (217, 217A) is formed through the wall of the second air room (214) and may communicate with the first air room (212).

The pumping assembly (22) is mounted in the housing (21), pumps the air to inflate the inflatable body (10) and has a motor (221) and a fan (222).

The motor (221) is mounted in the motor room (213) and has a shaft. The shaft extents into the second air room (214).

The fan (222) is mounted securely on the shaft, is mounted in the second air room (214) and is driven by the motor (221) to blow the air passing through the second opening (215).

Figure 3:
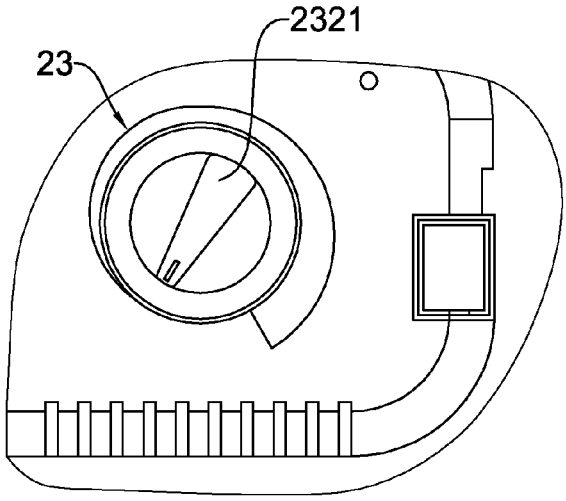
FIG. 3 is an enlarged front view of the pressure releasing valve in FIG. 2.
Figure 5:
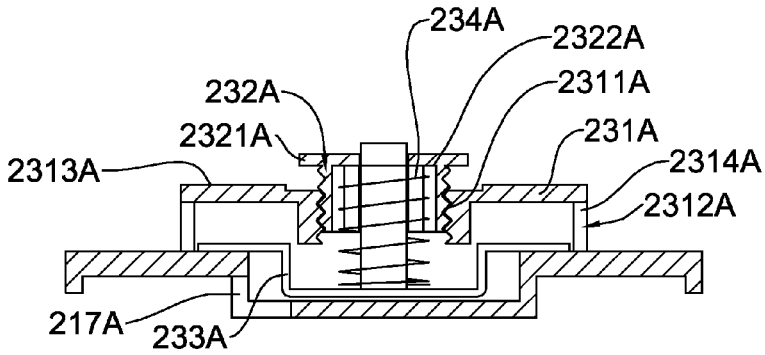
FIG. 5 is an enlarged operational top view in partial section of a pressure releasing valve in the inflatable product in FIG. 4 when the pressure releasing valve is closed.
Figure 6:
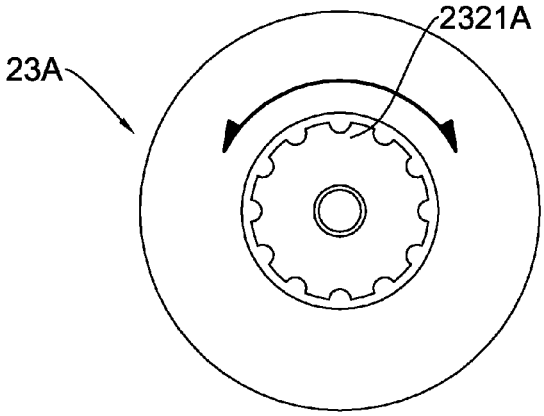
FIG. 6 is an enlarged front view of the pressure releasing valve in FIG. 5.
Figure 8:
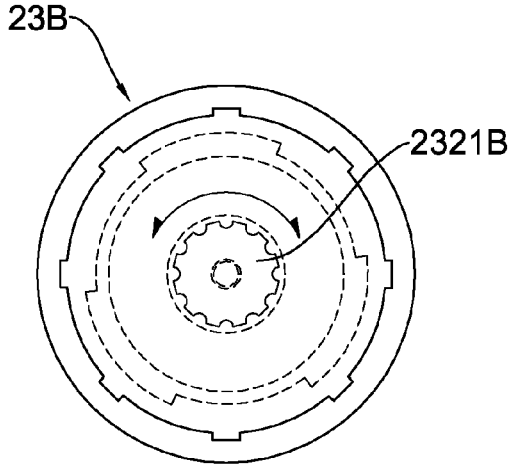
FIG. 8 is an enlarged front view of the pressure releasing valve in FIG. 7.

With further reference to FIGS. 3, 5, 6 and 8, the pressure releasing valve (23, 23A, 23B) is mounted between the outer wall of the housing (21) and the inflatable body (10), controls communication between an interior of the housing (21) and the outside environment and releases the air automatically when pressure of the air in the inflatable body (10) reaches a level to prevent the inflatable body (10) from being over-inflated. The pressure releasing valve (23, 23A, 23B) has a valve base (231, 231A, 231B), a valve knob (232, 232A, 232B), a valve lid (233, 233A, 2338), a spring (234, 234A, 234B) and an optional seal (235B). The pressure releasing valve (23, 23A) may be mounted on the wall of the second air room (214) and may selectively block the third opening (217, 217A), or the pressure releasing valve (23B) may be mounted on the inflatable body (10) near the opening (12) and may selectively block the opening (12) of the inflatable body (10).

The valve base (231, 231A, 231B) has a front surface (2313, 2313A, 2313B), an annular sidewall (2314, 2314A, 2314B), a threaded hole (2311, 2311A, 2311B) and a flowing outlet (2312, 2312A, 2312B). The valve base (231) may be mounted on the wall of the second air room (214) and extends out of the housing (21) through the outer wall (218) of the housing (21), or the valve base (231A) may be mounted on the wall of the second air room (214), or the valve base (231B) may be mounted on the inflatable body (10).

The threaded hole (2311, 2311A, 2311B) is formed through the front surface (2313, 2313A, 2313B) of the valve base (231, 231A, 231B).

The flowing outlet (2312, 2312A, 2312B) is formed through the annular sidewall (2314, 2314A, 2314B) of the valve base (231, 231A, 231B). The flowing outlet (2312, 2312A) may selectively communicate with the third opening (217, 217A) in the housing (21) or the flowing outlet (2312B) may selectively communicate with the opening (12) in the inflatable body (10).

The valve knob (232, 232A, 232B) is screwed in the threaded hole (2311, 2311A, 2311B), may extend out of the housing (21) and has a front (2322, 2322A, 2322B) and an adjusting head (2321, 2321A, 2321B). The adjusting head (2321, 2321A, 2321B) is formed on the front (2322, 2322A, 2322B) of the valve knob (232, 232A, 232B) for users to adjust height of the valve knob (232, 232A, 232B) by rotating the adjusting head (2321, 2321A, 2321B).

The valve lid (233, 233A, 233B) is mounted movably in the valve base (231, 231A, 231B). The valve lid (233, 233A) may selectively block the communication between the third opening (217, 217A) in the housing (21) and the flowing outlet (2312, 2312A) in the valve base (231, 231A), or the valve lid (233B) may selectively block the communication between the opening (12) in the inflatable body (10) and the flowing outlet (2312B) in the valve base (231B).

The spring (234, 234A, 234B) is mounted between the valve knob (232, 232A, 232B) and the valve lid (233, 233A, 233B) to press the valve lid (233, 233A, 233B).

The seal (235B) covers the valve base (231B).

The air flowing into the first opening (211) is pumped to pass through the first air room (212), the motor room (213) and the second air room (214) of the housing (21) and to flow out of the second opening (215). Consequently, mounting the motor (221) between the first opening (211) and the second opening (215) dissipates the heat of the motor because the air passing by the motor (221) cools the motor (221). Moreover, the air will be released from the pressure releasing valve (23, 23A, 23B) automatically when the pressure of the air exceeds pressure of the spring (234, 234A, 234B) so the inflatable body (10) is kept in a desired inflated condition and the constant air flow would also continue to dissipate heat of the motor.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. An inflatable product comprising:

an inflatable body being hollow and having a mounting cavity being formed within the inflatable body;

an air pump device being mounted on the inflatable body and in the mounting cavity of the inflatable body and comprising a housing being mounted on the inflatable body and in the mounting cavity of the inflatable body and having an outer wall protruding out of the inflatable body;

an inner wall being disposed in the mounting cavity of the inflatable body and being opposite to the outer wall of the housing;

a first opening being formed through the outer wall of the housing;

a first air room being formed inside the housing, extending from the outer wall to the inner wall of the housing and having an outer end corresponding to the outer wall of the housing and communicating with the first opening; and an inner end corresponding to the inner wall of the housing;

a second air room being formed inside the housing, being disposed beside the outer wall of the housing, communicating with the inner end of the first air room and having a wall; and a second opening being formed through the wall of the second air room of the housing and communicating with the mounting cavity of the inflatable body; and a pumping assembly being mounted in the housing and having a motor being mounted in the housing between the inner end of the first air room and the second air room and having a shaft extending into the second air room; and a fan being mounted securely on the shaft, being mounted in the second air room and being driven by the motor; and a pressure releasing valve being mounted between the outer wall of the housing and the inflatable body, controlling communication between an interior of the housing and outside environment and releasing overpressure air in the inflatable body;

wherein air flowing into the first opening is pumped to pass through the first air room, the motor and the second air room and to flow out of the second opening to dissipate heat of the motor in the housing.

2. The inflatable product as claimed in claim 1, wherein the housing further has a motor room being formed inside the housing and having an inner opening communicating with the first air room; and an outer opening communicating with the second air room; and the motor is mounted in the motor room;

wherein the air flowing into the first opening is pumped to pass through the first air room, the motor room and the second air room and to flow out of the second opening to dissipate heat of the motor in the motor room.

3. The inflatable product as claimed in claim 2, wherein the air pump device further has a third opening being formed through the wall of the second air room; and the pressure releasing valve is mounted on the wall of the second air room and selectively blocks the third opening.

4. The inflatable product as claimed in claim 3, wherein the pressure releasing valve has a valve base being mounted on the wall of the second air room and having a front surface;

an annular sidewall;

a threaded hole being formed through the front surface of the valve base; and a flowing outlet being formed through the annular sidewall of the valve base and communicating with the third opening in the housing;

a valve knob being screwed in the threaded hole and having a front; and an adjusting head being formed on the front of the valve knob;

a valve lid being mounted movably in the valve base and selectively blocking a communication between the third opening in the housing and the flowing outlet in the valve base; and a spring being mounted between the valve knob and the valve lid.

5. The inflatable product as claimed in claim 4, wherein the valve base extends out of the housing through the outer wall of the housing.

6. The inflatable product as claimed in claim 5, wherein the third opening communicates with the first air room.

7. The inflatable product as claimed in claim 1, wherein the inflatable body further has an opening being formed through the inflatable body; and the pressure releasing valve is mounted on the inflatable body near the opening and selectively blocks the opening of the inflatable body.

8. The inflatable product as claimed in claim 7, wherein the pressure releasing valve has a valve base being mounted on the inflatable body and having a front surface;

an annular sidewall a threaded hole being formed through the front surface of the valve base; and a flowing outlet being formed through the annular wall of the valve base and communicating with the opening in the inflatable body;

a valve knob being screwed in the threaded hole and having a front; and an adjusting head being formed on the front of the valve knob;

a valve lid being mounted movably in the valve base and selectively blocking a communication between the opening in the inflatable body and the flowing outlet in the valve base; and a spring being mounted between the valve knob and the valve lid.

9. The inflatable product as claimed in claim 8, wherein the pressure releasing valve further has a seal covering the valve base.

10. The inflatable product as claimed in claim 1, wherein the inflatable body further has an inflating cavity being formed within the inflatable body and being separated from the mounting cavity;

an inflating tube being mounted in the mounting cavity and communicating with the inflating cavity; and the second opening in the housing communicates with the inflating tube.

11. The inflatable product as claimed in claim 10, wherein the housing of the air pump device further has a connecting room being formed between the second opening and the inflating tube, wherein the connecting room connects and communicates with the second opening and the inflating tube.

12. The inflatable product as claimed in claim 1, wherein the pressure releasing valve is mounted on the housing.

13. The inflatable product as claimed in claim 12, wherein the housing further has a motor room being formed inside the housing and having an inner opening communicating with the inner end of the first air room; and an outer opening communicating with the second air room; and the motor is mounted in the motor room; and the air flowing into the first opening is pumped to pass through the first air room, the motor room and the second air room and to flow out of the second opening to dissipate heat of the motor in the motor room.

14. The inflatable product as claimed in claim 1, wherein the air pump device further has a third opening being formed through the housing; and the pressure releasing valve is connected to the housing.

15. The inflatable product as claimed in claim 14, wherein the pressure releasing valve further has a valve base being mounted on the housing and having a front surface;

an annular sidewall;

a threaded hole being formed through the front surface of the valve base; and a flowing outlet being formed through the annular sidewall of the valve base and communicating with the third opening in the housing;

a valve knob being screwed in the threaded hole and having a front; and an adjusting head being formed on the front of the valve knob;

a valve lid being mounted movably in the valve base and selectively blocking a communication between the third opening in the housing and the flowing outlet in the valve base; and a spring being mounted between the valve knob and the valve lid.

16. An air pump device comprising:

a housing having an outer wall;

an inner wall being opposite to the outer wall of the housing;

a first opening being formed through the outer wall of the housing;

a first air room being formed inside the housing, extending from the outer wall to the inner wall of the housing and having an outer end corresponding to the outer wall of the housing and communicating with the first opening; and an inner end corresponding to the inner wall of the housing;

a second air room being formed inside the housing, being disposed beside the outer wall of the housing, communicating with the inner end of the first air room and having a wall; and a second opening being formed through the wall of the second air room of the housing; and a pumping assembly being mounted in the housing and having a motor being mounted in the housing between the inner end of the first air room and the second air room and having a shaft extending into the second air room; and a fan being mounted securely on the shaft, being mounted in the second air room and being driven by the motor;

wherein air flowing into the first opening is pumped to pass through the first air room, the motor and the second air room and to flow out of the second opening to dissipate heat of the motor in the housing.

17. The air pump device as claimed in claim 16, wherein the housing further has a motor room being formed inside the housing and having an inner opening communicating with the inner end of the first air room; and an outer opening communicating with the second air room; and the motor is mounted in the motor room; and the air flowing into the first opening is pumped to pass through the first air room, the motor room and the second air room and to flow out of the second opening to dissipate heat of the motor in the motor room.

* * * * *